United States Patent [19]

El-Sayed Lyla M. et al.

[11] Patent Number: 4,798,778

[45] Date of Patent: Jan. 17, 1989

[54] LIQUID ELECTROSTATIC DEVELOPERS CONTAINING MODIFIED RESIN PARTICLES

[75] Inventors: El-Sayed Lyla M., West Chester, Pa.; Steven P. Schmidt, Greenville; Torence J. Trout, Wilmington, both of Del.; Robert D. Mitchell, Pittsford, N.Y.

[73] Assignee: E. I. Du Pont de Nemours and Company, Wilmington, Del.

[21] Appl. No.: 80,669

[22] Filed: Aug. 3, 1987

[51] Int. Cl.[4] ..... G03G 9/12

[52] U.S. Cl. ..... 430/115; 430/137

[58] Field of Search ..... 430/115, 137

[56] References Cited

U.S. PATENT DOCUMENTS 3,788,995 1/1974 Stahly et al. ..... 252/62.1
3,849,165 11/1974 Stahly et al. ..... 117/37
4,707,429 11/1987 Trout ..... 430/115

FOREIGN PATENT DOCUMENTS 161025 8/1984 German Democratic Rep. .
218697 2/1985 German Democratic Rep. .
218698 2/1985 German Democratic Rep. .
218699 2/1985 German Democratic Rep. .

*Primary Examiner*—John L. Goodrow

[57] ABSTRACT

A positive-working liquid electrostatic developer consisting essentially of (A) nonpolar liquid having a Kauri-butanol value of less than 30, present in major amount;

(B) thermoplastic resin of an ethylene homopolymer or copolymer of ethylene and at least one other monomer, the resin having as a substituent thereon an ester, ester having substitutents, e.g., hydroxyl, carboxyl, amine, alkyl; an amide, amide having substituents, e.g., hydroxyl, carboxyl, amine, alkyl; or acid halide of a carboxylic acid, the resin being in particulate form having an average particle size by area of less than 10 $\mu$m; and (C) nonpolar liquid soluble ionic or zwitterionic compound.

Several procedures can be used to prepare the developer, e.g., using toner concentrate, modifying a thermoplastic resin before developer is prepared. Pigments and adjuvants can be present in the developer which is useful in copying, making proofs including digital proofs, lithographic printing plates and resists.

60 Claims, No Drawings

LIQUID ELECTROSTATIC DEVELOPERS CONTAINING MODIFIED RESIN PARTICLES

DESCRIPTION

TECHNICAL FIELD

This invention relates to a liquid electrostatic developer. More particularly, this invention relates to a positive-working liquid electrostatic developer containing a modified resin having ester, amide, or acid chloride of carboxylic acid substituents.

BACKGROUND ART

It is known that a latent electrostatic image can be developed with toner particles dispersed in an insulating nonpolar liquid. Such dispersed materials are known as liquid toners or liquid developers. A latent electrostatic image may be produced (1) by providing a photoconductive layer or surface, e.g., photopolymerized, with a uniform electrostatic charge and subsequently discharging the electrostatic charge by exposing it to a modulated beam of radiant energy, or (2) by applying a uniform electrostatic charge on an imagewise exposed photopolymer surface. Other methods are known for forming latent electrostatic images. For example, one method is providing a carrier with a dielectric surface and transferring a preformed electrostatic charge to the surface. Useful liquid toners comprise a thermoplastic resin and dispersant nonpolar liquid. Generally a suitable colorant is present such as a dye or pigment. The colored toner particles are dispersed in the nonpolar liquid which generally has a high-volume resistivity in excess of $10^9$ ohm centimeters, a low dielectric constant below 3.0 and a high vapor pressure. The toner particles are less than 10 μm average by area size. After the latent electrostatic image has been formed, the image is developed by the colored toner particles dispersed in said dispersant nonpolar liquid and the image may subsequently be transferred to a carrier sheet.

Since the formation of proper images depends on the differences of the charge between the liquid developer and the latent electrostatic image to be developed, it has been found desirable to add a charge director compound and preferably adjuvants, e.g., polyhydroxy compounds, aminoalcohols, polybutylene succinimide, an aromatic hydrocarbon, etc., to the liquid developer comprising the thermoplastic resin, dispersant nonpolar liquid, and preferably a colorant dispersed in the thermoplastic resin. Other adjuvants, e.g., metallic soaps such as aluminum tristearate, etc., and metal salts can also be dispersed in the resin. Such liquid developers provide images of good resolution. Controlling the magnitude and polarity of liquid electrostatic developers is a necessary but difficult task. For example, the charging and image quality of such liquid developers are particularly pigment dependent. In addition, many of the previously known liquid electrostatic developers are negative-working, i.e., they are attracted to surfaces that are positively charged.

There is a need for a positive-working liquid electrostatic developer having good quality solid area coverage, resolution and toning of fine details which is prepared from dispersant nonpolar liquid, ionic or zwitterionic charge director, and a thermoplastic resin preferably having dispersed therein a colorant.

DISCLOSURE OF THE INVENTION

In accordance with this invention there is provided a positive-working liquid electrostatic developer consisting essentially of (A) nonpolar liquid having a Kauri-butanol value of less than 30, present in major amount, (B) thermoplastic resin selected from the group consisting of an ethylene homopolymer having a carboxylic acid substituent and copolymer of ethylene and at least one other monomer having a carboxylic acid substituent, the acid substituent being modified into a substituent selected from the group consisting of an ester, ester having substituents selected from the group consisting of hydroxyl, carboxyl, amine and alkyl of at least one carbon atom; amide, amide having substituents selected from the group consisting of hydroxyl, carboxyl, amine and alkyl of at least one carbon atom; and acid halide, the resin being in particulate form having an average particle size by area of less than 10 μm, and (C) nonpolar liquid soluble ionic or zwitterionic compound.

In accordance with an embodiment of this invention, there is provided a process for preparing a positive working liquid eleotrostatic developer for electrostatic imaging comprising (A) mixing in a vessel at an elevated temperature a thermoplastic resin taken from the group consisting of an ethylene homopolymer having a carboxylic acid substituent and copolymer of ethylene and at least one other monomer, the copolymer having a carboxylic acid substituent, and a dispersant nonpolar liquid having a Kauributanol value of less than 30, while maintaining the temperature in the vessel at a temperature sufficient to plasticize and liquify the resin and below that at which the dispersant nonpolar liquid degrades and the resin decomposes, (B) cooling the dispersion with stirring to form thermoplastic resin particles having an average by area particle size of less than 10 μm, (C) separating the thermoplastic resin particles from the nonpolar liquid, (D) suspending the thermoplastic resin particles in an organic liquid, (E) reacting the suspension of the thermoplastic resin particles, in the presence of a dehydrating agent, with a compound selected from the group consisting of an alkylamine, alkylhydroxide, aminoalcohol, aminoacid and hydroxyacid compound having at least one functional group and wherein alkyl contains at least one carbon atom to form modified resin particles having an amide and/or an ester substituent, (F) separating the modified resin particles from the suspension organic liquid and suspending the modified resin particles in nonpolar liquid, (G) charging positively the suspension by means of a nonpolar liquid soluble ionic or zwitterionic compound. In accordance with another embodiment of this invention there is provided a process for preparing a positive-working liquid electrostatic developer for electrostatic imaging comprising (A) dissolving in an organic solvent in a vessel at an elevated temperature a thermoplastic resin taken from the group consisting of an ethylene homopolymer having a carboxylic acid substituent and copolymer of ethylene and at least one other monomer, the copolymer having a carboxylic acid substituent, the temperature in the vessel being below that at which the resin decomposes, (B) cooling the resin solution to a temperature sufficient for the resin to remain substantially dissolved and adding to the solution a halide-containing compound capable of reacting with the carboxylic acid substituent of the resin to form an acid halide, (C) quenching the acid halide at ambient temperature with a compound selected from the group consisting of alkylamine, alkylhydroxide, aminoalcohol, aminoacid, and hydroxyacid compound having at least one functional group and wherein alkyl contains at least one carbon atom, and drying, (D) mixing in a vessel at an elevated temperature the modified resin and a dispersant nonpolar liquid having a Kauributanol value of less than 30, present in major amount, while maintaining the temperature in the vessel at a temperature sufficient to plasticize and liquify the resin and below that at which the dispersant nonpolar liquid degrades and the resin decomposes, (E) cooling the dispersion with stirring to form thermoplastic resin particles having an average by area particle size of less than 10 μm, (F) charging positively the liquid developer by means of a nonpolar liquid soluble ionic or zwitterionic compound.

In the claims appended hereto "consisting essentially of" means the composition of the liquid electrostatic developer does not exclude unspecified components which do not prevent the advantages of the developer from being realized. For example, in addition to the primary components, there can be present additional components, such as colorant, fine particle size oxides, adjuvant, e.g., polyhydroxy compound, aminoalcohol, polybutylene succinimide, aromatic hydrocarbon, metallic soap, etc.

The dispersant nonpolar liquids (A) are, preferably, branched-chain aliphatic hydrocarbons and more particularly, Isopar®-G, Isopar®-H, Isopar®-K, Isopar®-L, Isopar®-M and Isopar®-V. These hydrocarbon liquids are narrow cuts of isoparaffinic hydrocarbon fractions with extremely high levels of purity. For example, the boiling range of Isopar®-G is between 157° C. and 176° C., Isopar®-H between 176° C. and 191° C., Isopar®-K between 177° C. and 197° C., Isopar®-L between 188° C. and 206° C. and Isopar®-M between 207° C. and 254° C. and Isopar®-V between 254.4° C. and 329.4° C. Isopar®-L has a mid-boiling point of approximately 194° C. Isopar®-M has a flash point of 80° C. and an auto-ignition temperature of 338° C. Stringent manufacturing specifications, such as sulphur, acids, carboxyl, and chlorides are limited to a few parts per million. They are substantially odorless, possessing only a very mild paraffinic odor. They have excellent odor stability and are all manufactured by the Exxon Corporation. High-purity normal paraffinic liquids, Norpar®12, Norpar®13 and Norpar®15, Exxon Corporation, may be used. These hydrocarbon liquids have the following flash points and auto-ignition temperatures:

| Liquid | Flash Point (°C.) | Auto-Ignition Temp (°C.) |
|---|---|---|
| Norpar® 12 | 69 | 204 |
| Norpar® 13 | 93 | 210 |

-continued

| Liquid | Flash Point (°C.) | Auto-Ignition Temp (°C.) |
|---|---|---|
| Norpar® 15 | 118 | 210 |

All of the dispersant nonpolar liquids have an electrical volume resistivity in excess of $10^9$ ohm centimeters and a dielectric constant below 3.0. The vapor pressures at 25° C. are less than 10 Torr. Isopar®-G has a flash point, determined by the tag closed cup method, of 40° C., Isopar®-H has a flash point of 53° C. determined by ASTM D 56. Isopar®-L and Isopar®-M have flash points of 61° C., and 80° C., respectively, determined by the same method. While these are the preferred dispersant nonpolar liquids, the essential characteristics of all suitable dispersant nonpolar liquids are the electrical volume resistivity and the dielectric constant. In addition, a feature of the dispersant nonpolar liquids is a low Kauri-butanol value less than 30, preferably in the vicinity of 27 or 28, determined by ASTM D 1133. The ratio of thermoplastic resin to dispersant nonpolar liquid is such that the combination of ingredients becomes fluid at the working temperature. The nonpolar liquid is present in an amount of 85 to 99.99% by weight, preferably 97 to 99.5% by weight, based on the total weight of liquid developer. The total weight of solids in the liquid developer is 0.01 to 15%. Preferably 0.5 to 3.0% by weight. The total weight of solids in the liquid developer is solely based on the resin, including components dispersed therein, e.g., pigment component, adjuvant, etc.

Useful thermoplastic resins or polymers are ethylene homopolymers or copolymers of ethylene and at least one other monomer, each of the polymers having a carboxylic acid substituent which has been modified into an ester, substituted ester, amide, substituted amide or acid halide. The modified polymers may contain a minor amount of free acid, e.g., about 0.001 to 6% by weight due to unreacted carboxylic acid substituent of the polymer. If the modified resin is an ester having a carboxyl substituent then the amount of free acid may be greater than 6%, e.g., up to 25% by weight based on the weight of polymer. The modified resin may be made by using developer concentrate or modifying the resin before it is made into developer. Reaction procedures are more fully described below.

Useful polymeric resins which can be converted into the ester, substituted ester, amide, substituted amide or acid halide species include: ethylene homopolymer having carboxylic acid substituents, e.g., oxidized polyethylene; copolymers of ethylene and at least one other monomer, a carboxylic acid substituent being present. Examples of such copolymers containing a monofunctional acid substituent which is preferred include: etbylene/acrylic acid copolymers, ethylene/methacrylic acid copolymers, ethylene/acrylic acid/methyl methacrylate copolymers, ethylene/methacrylic acid/ethyl acrylate copolymers, ethylene/methacrylic acid/vinyl acetate copolymers, ethylene/acrylic acid/vinyl formate copolymers, ethylene/propylene/acrylic acid copolymers, ethylene/styrene/acrylic acid copolymers, ethylene/vinyl chloride/acrylic acid copolymers, ethylene/vinylidene chloride/acrylic acid copolymers, ethylene/vinyl fluoride/methacrylic acid copolymers, and ethylene/chlorotrifluoroethylene/methacrylic acid copolymers. Copolymers are also useful that contain a difunctional acid substituent, e.g., ethylene/itaconic acid copolymers, ethylene/itaconic acid/methyl methacrylate copolymers, etc. Preferred examples of copolymers of ethylene having carboxylic acid substituent include: copolymers of ethylene and an $\alpha,\beta$-ethylenically unsaturated acid selected from the group consisting of acrylic acid and methacrylic acid; copolymers of ethylene (80 to 99.99%)/acrylic or methacrylic acid (20 to 0.01%)/alkyl ($C_1$ to $C_5$) ester of methacrylic or acrylic acid (0 to 19.99%).

Especially preferred copolymers are the copolymer of ethylene and an $\alpha,\beta$-ethylenically unsaturated acid of either acrylic acid or methacrylic acid. The synthesis of copolymers of this type are described in Rees U.S. Pat. No. 3,264,272, the disclosure of which is incorporated herein by reference. For the purposes of preparing the preferred copolymers, the reaction of the acid containing copolymer with the ionizable metal compound, as described in the Rees patent, is omitted. The ethylene constituent is present in about 80 to 99.99% by weight of the copolymer and the acid component in about 20 to 0.01% by weight of the copolymer. The acid numbers of the copolymers range from 1 to 120, preferably 54 to 90. Acid No. is milligrams potassium hydroxide required to neutralize 1 gram of polymer. The melt index (g/10 min) of 10 to 500 is determined by ASTM D 1238, Procedure A. Particularly preferred copolymers of this type have an acid number of 66 and 60 and a melt index of 100 and 500 determined at 190° C., respectively.

In addition, the resins have the following preferred characteristics:

1. Be able to disperse therein, if present, a colorant, e.g., pigment; adjuvants such as metallic soap, etc.
2. Be substantially insoluble in the nonpolar liquid (A) at temperatures below 40° C., so that the thermoplastic resin will not dissolve or solvate in storage,
3. Be able to solvate at temperatures above 50° C.,
4. Be able to be ground to form particles between 0.1 μm and 5 μm, in diameter,
5. Be able to form a particle (average by area) of less than 10 μm, e.g., determined by Horiba CAPA-500 centrifugal automatic particle analyzer, manufactured by Horiba Instruments, Inc., Irvine, C.A.: solvent viscosity of 1.24 cps, solvent density of 0.76 g/c.c., sample density of 1.32 using a centrifugal rotation of 1,000 r.p.m., a particle size range of 0.01 to less than 10 μm, and a particle size cut of 1.0 μm.
6. Be able to fuse at temperatures in excess of 70° C. By solvation in 3. above, the resins forming the toner particles will become softened, swollen, or gelatinous.

Suitable nonpolar liquid soluble ionic or zwitterionic charge director compounds (C), which are generally used in an amount of 0.25 to 1500 m.g./g., preferably 2.5 to 400 m.g./g. developer solids, include: positive charge directors, e.g., sodium dioctylsulfosuccinate (manufactured by American Cyanamid Co.), metallic soaps such as copper oleate, zirconium octoate, iron naphthenate; Basic Barium Petronate® oil-soluble petroleum sulfonate, and neutral Barium Petronate® manufactured by Sonneborn Division of Witco Chemical Corp., New York, N.Y., lecithin, etc.

As indicated above, colorants are preferably dispersed in the resin. Colorants, such as pigments or dyes and combinations thereof, are preferably present to render the latent image visible. The colorant, e.g., a pigment, may be present in the amount of up to about 60 percent by weight based on the total weight of developer solids, preferably 0.1 to 30% by weight based on the total weight of developer solids. The amount of colorant may vary depending on the use of the developer. Examples of pigments are Monastral® Blue G (C.I. Pigment Blue 15 C.I., No. 74160), Toluidine Red Y (C.I. Pigment Red 3), Quindo® Magenta (Pigment Red 122), Indo® Brilliant Scarlet (pigment Red 123, C.I. No. 71145), Toluidine Red B (C.I. Pigment Red 3), Watchung® Red B (C.I. Pigment Red 48), Permanent Rubine F6B13-1731 (Pigment Red 184), Hansa® Yellow (Pigment Yellow 98), Dalamar® Yellow (Pigment Yellow 74, C.I. No. 11741). Toluidine Yellow G (C.I. Pigment Yellow 1), Monastral® Blue B (C.I. Pigment Blue 15), Monastral® Green B (C.I. Pigment Green 7), Pigment Scarlet (C.I. Pigment Red 60), Auric Brown (C.I. Pigment Brown 6), Monastral® Green G (Pigment Green 7), Carbon Black, Cabot Mogul L (black pigment C.I. No. 77266) and Sterling NS N 774 (Pigment Black 7, C.I. No. 77266).

Other ingredients may be added to the liquid electrostatic developer, such as fine particle size oxides, e.g., silica, alumina, titania, etc.; preferably of the order of 0.5 μm or less can be dispersed into the liquefied resin. These oxides can be used in combination with the colorant. Metal particles can also be added.

Another additional component of the liquid electrostatic developer is an adjuvant which can be taken from the group of polyhydroxy compound which contains at least 2 hydroxy groups, aminoalcohol, polybutylene succinimide, metallic soap, and aromatic hydrocarbon having a Kauri-butanol value of greater than 30. The adjuvants are generally used in an amount of 1 to 1000 mg/g. Preferably 1 to 200 mg/g developer solids. Examples of the various above-described adjuvants include:

polyhydroxy compounds: ethylene glycol, 2,4,7,9-tetramethyl-5-decyn-4,7-diol, poly(propylene glycol). Pentaethylene glycol, tripropylene glycol, triethylene glycol, glycerol, pentaerythritol, glycerol-tri-12 hydroxystearate, ethylene glycol monohydroxystearate, propylene glycerol monohydroxy-stearate, etc.

aminoalcohol compounds: triisopropanolamine, triethanolamine, ethanolamine, 3-amino-1-propanol, o-aminophenol, 5-amino-1-pentanol, tetra(2-hydroxyethyl)ethylenediamine, etc.

polybutylene succinimide: OLOA®-1200 sold by Chevron Corp., analysis information appears in Kosel U.S. Pat. No. 3,900,412 column 20, lines 5 to 13 incorporated herein by reference: Amoco 575 having a number average molecular Weight of about 600 (vapor pressure osmometry) made by reacting maleic anhydride with polybutene to give an alkenylsuccinic anhydride which in turn is reacted with a polyamine. Amoco 575 is 40 to 45% surfactant, 36% aromatic hydrocarbon, and the remainder oil, etc.

metallic soap: aluminum tristearate: aluminum distearate: barium calcium lead and zinc stearates; cobalt, manganese, lead and zinc linoleates; aluminum calcium and cobalt octoates; calcium and cobalt oleates; zinc palmitate; calcium, cobalt, manganese, lead and zinc naphthenates; calcium, cobalt, manganese, lead and zinc resinates; etc. The metallic soap is dispersed in the thermoplastic resin as described in Trout, U.S. application Ser. No. 857,326, filed Apr. 30, 1986, the dlsclosure of which is incorporated herein by reference.

aromatic hydrocarbon: benzene, toluene, naphthalene, substituted benzene and naphthalene compounds, e.g., trimethylbenzene, xylene, dimethylethylbenzene, ethylmethylbenzene, propylbenzene, Aromatic 100 which is a mixture of $C_9$ and $C_{10}$ alkyl-substituted benzenes manufactured by Exxon Corporation etc.

The particles in the liquid electrostatic developer have an average by area particle size of less than 10 μm, preferably the average by area particle size is less than 5 μm. The modified resin particles of the developer may or may not be formed having a plurality of fibers integrally extending therefrom although the formation of fibers extending from the toner particles is preferred. The term "fibers" as used herein means pigmented toner particles formed with fibers, tendrils, tentacles, threadlets, fibrils, ligaments, hairs, bristles, or the like.

The modified thermoplastic resin can be repared by several procedures. For example, it can be made using toner concentrate or by modifying a thermoplastic resin before it is used to prepare liquid electrostatic developer. These methods are illustrated in the examples below. In a method using toner concentrate, the polymeric resin having carboxylic acid substituent, nonpolar dispersant liquid, and optionally, the colorant are placed ln a suitable mixing or blending vessel, e.g., attritor, heated ball mill, heated vibratory mill such as a SWeco Mill manufactured by SWeco Co. Los Angeles, Calif., equipped with particulate media, for dispersing and grinding, Ross double planetary mixer manufactured by Charles Ross and Son. Hauppauge, N.Y., etc. or a two roll heated mill (no particulate media necessary) and are mixed in the vessel at elevated temperature, i.e., the temperature of ingredients in the vessel being sufficient to plasticize and liquify the resin but being below that at which the dispersant nonpolar liquid degrades and the resin and/or colorant decomposes. A preferred temperature range is 80° to 120° C. Other temperatures outside this range may be suitable, however, depending on the particular ingredients used. The presence of the irregularly moving particulate media in the vessel is preferred to prepare the mixture. Other stirring means can be used as well, however, to prepare liquid developer having particles of proper size, configuration and morphology. Useful particulate media are particulate materials, e.g., spherical, cylindrical, etc. taken from the class consisting of stainless steel, carbon steel, alumina, ceramic, zirconium, silica, and sillimanite. Carbon steel particulate media is particularly useful when colorants other than black are used. A typical diameter range for the particulate media is in the range of 0.04 to 0.5 inch (1.0 to approx. 13 mm).

After the ingredients in the vessel are mixed until the desired consistency is aohieved. typically 1 to 2 hours with the mixture being fluid, the mixture is cooled, e.g., in the range of 0° C. to 50° C. Cooling may be accomplished, for example, in the same vessel, such as the attritor, while simultaneously grinding in the presence of additional liquid with particulate media. Cooling is accomplished by means known to those skilled in the art and is not limited to cooling by circulating cold water or a cooling material through an external cooling jacket adjacent the dispersing apparatus or permitting the mixture to cool to ambient temperature. The resin solidifies or precipitates out of the nonpolar liquid during the cooling. Toner particles of average particle size (by area) of less than 10 μm, as determined by a Horiba CApA-500 centrifugal particle analyzer described above or other comparable apparatus, are formed by grinding for a relatively short period of time.

The solid material obtained is separated from the particulate media, if present, and the nonpolar liquid by means known to those skilled in the art. A centrifuge, for example, is useful in separating the solid material from the nonpolar liquid. The solid material is then suspended in an organic liquid such as dichloromethane, diethylether, tetrachloromethane, Freon ® 113 Fluorocarbon, etc. and various reactants. etc., amines, diamines, polyamines; alcohols, dialcohols, polyalcohols, aminoalcohols, aminoacid, hydroxyacid, etc., are added to form the modified resin, i.e., amide or ester. In forming the amide, useful alkylamines include: cocoamine, ethylene diamine, octadecyl amine, aniline, lysine, glycine tryptophan, etc. In forming the ester, useful alkylhydroxides, hydroxy-containinq compounds or glycols, include: ethylene glycol. Poly(propylene glycol), 2,4,7,9-tetramethyl-5-decyn-4,7-diol, pentaethylene glycol, tripropylene glycol, triethylene glycol, glycerol, pentaerythritol, glycerol-tri 12 hydroxystearate, propylene glycerol monohydroxystearate, ethylene glycerol monohydroxystearate ricinoleic acid, 10-hydroxystearic acid, 16-hydroxyhexadecanoic acid, 15-hydr©xypentadecanoic acid, 12-hydroxydodecanoic acid, 4-hydroxybenzoic acid, 2-hydroxy-1-naphthoic acid, 3-hydroxy-2-naphthoic acid, 1-hydroxy-2-naphthoic acid, 2-hydroxyphenylacetic acid, 3-hydroxyphenylacetic acid, 4-hydroxyphenylacetic acid, and 3-(4-bydroxyphenyl)-propionic acid, etc.

The following amino alcohols are examples of compounds that may be used in forming either the amide or the ester or mixtures of an amide and an ester, e.g. triisopropanolamine, triethanolamine, ethanolamine, 3-amino-1-propanol, o-aminophenol, 5-amino-1-pentanol, tetra(2-hydroxyethyl)ethylene diamine, etc. In addition to either an alkylamine or alkylhydroxide, dehydrating agents, e.g., dicyclohexylcarbodiimide. 1-cyclohexyl-3-(2-morpholinoethyl)carbodiimidemetho-p-toluenesulfonate, 1-(3-dimethylaminopropyl)-3-N-ethoxycarbonyl-2-ethoxy-1,2-di-hydroquinoline. etc., are present Additives such as 1-hydroxybenzotriazole hydrate, N-hydroxy-succinimide are known to enhance the rate of reaction and increase the yield. After a suitable time the solid is separated from the suspension liquid and is rinsed with and then suspended in a nonpolar liquid of a type described aboVe. The suspension is then diluted tc 0.01 to 15%. Preferably 0,2 to 2% by weight solids with additional nonpolar liquid. To the liquid developer is added one or more of the charge directors described above or other known charge director, preferably in nonpolar liquid to provide the positively charged liquid electrostatic developer.

The developer can be evaluated by toning a negatively charged xeroprinting master, e.g. imagewise exposed photopolymer element capable of charging, a photo conductive film, etc. A toned image with a range of 2 to 95% halftone dots (150 line/inch screen) is generally obtained which also exhibits good solid area coverage.

In another preparation method a thermoplastic resin is modified before it is used to prepare liquid electrostatic developer. In such process an amount of the resin and an organic solvent in which it has partial solubility, e.g., benzene toluene, etc., are placed in a vessel equipped with a condenser, stir bar, thermocouple and heater e.g., heating mantle. The mixture is heated in the range of about 85° to 110° C. until the resin dissolves and then cooled to a temperature to keep the resin substantially in solution, e.g., 55° to 95° C. and a halogenating agent is used to prepare acid halides, e.g., $SOCl_2$, oxalyl bromide or chloride, allylbenzene sulfonyl bromide or chloride, phosphorous pentachloride, etc., is added in stoichiometric amount to form an acid halide. After heatinq at the reduced :emperature for about 15 minutes to 2 hours, the mixture is quenched into a room temperature mixture of, for example. acetone/water to reform the acid, acetone/alcohol mixture to form an ester, acetone/amine to form an amide and a neat hydroxy acid to form a substituted ester; filtered rinsed with organic liquid such as acetone, chloroform, etc., and dried, e.g., 35° C. in an oven, etc. The existence of the acid chloride and ester formation is confirmed by use of an infrared spectrometer whereby the shifted carbonyl peak is noted. The peaks are 1710 $cm^{-1}$ for the unmodified resin, 1810 $cm^{-1}$ for the acid chloride and 1740 $cm^{-1}$ for the resin derivate, respectively. The acid halide can be used to make esters and amides of the type described above.

The modified acid halide, ester substituted ester, or amide resin is processed into developer by mixing or blending with pigment, adjuvants, nonpolar liquid, etc., at elevated temperature, followed by cooling as described above. Preferably the concentration of the resin particles is reduced, e.g., by the addition of nonpolar liquid, and a charge director such as described above, preferably Basic Barium petronated, is added. The concentration of the toner particles in the dispersion is reduced by the addition of additional dispersant nonpolar liquid. The dilution is normally conducted to reduce the concentration of toner particles to between 0.1 to 10 percent by weight, preferably 0.3 to 3.0, and more preferably 0 5 to 2 weight percent with respect to the dispersant nonpolar liquid. One or more nonpolar liquid soluble ionic or zwitterionic charge director compounds (C), of the type set out above, can be added to impart a positive charge, as desired. The addition may occur at any time during the process; preferably at the end of the process, e.g., after the particulate media, if used, are removed and the concentration of toner particles is accomplished. If a diluting dispersant nonpolar liquid is also added, the ionic or zwitterionic compound can be added prior to, concurrently with, or subseguent thereto. If an adjuvant compound of a type described above has not been previously added in the preparation of the developer, it can be added prior to or subsequent to the developer being charged. Preferably the adjuvant compound is added after the dispersing step.

INDUSTRIAL APPLICABILITY

The liquid electrostatic developers of this contain modified thermoplastic resin in particulate form, the particles being exclusively positively charged. The images produced good quality solid area coverage as well as resolution and toning of fine details independent of charge director and pigment present. The developers are useful in copying, i.e., making office copies of black and white as well as various colors: or color proofing e.g., a reproduction of an image using the standard colors: yellow, cyan, magenta together with black as desired. In copying and proofing the particles of the developer are applied to a latent electrostatic image and can be transferred, if desired. Other uses envisioned for the developers include but are not limited to: digital color proofing, lithographic printing plates, and resists, preferably nonpigmented.

EXAMPLES

The following controls and examples wherein the percentages are by weight illustrate but do not limit the invention. In the Examples the melt indices were determined by ASTM D 1238, procedure A and the average particle sizes by area were determined by a Horiba CAPA-500 centrifugal particle analyzer as described above.

EXAMPLE 1

In a 30-S Attritor ®, Union process Company, Akron, Ohio were placed the following ingredients:

| Ingredient | Amount (lbs) |
|---|---|
| Copolymer of ethylene (89%) and methacrylic acid (11%) melt index at 190° C. is 100, Acid No. is 66 | 13.20 |
| Heucophthal Blue G XBT-583D Heubach, Inc., Newark, NJ | 0.09 |
| Carbon black Sterling NS, Cabot Corp., Boston, MA | 1.71 |
| Isopar ®-L, nonpolar liquid having a Kauri-butanol value of 27, Exxon Corporation | 65.0 |

The ingredients were heated in the range of 90° C. to 110° C. and milled with 0.1875 inch (4.76 mm) diameter carbon steel balls for two hours. The Attritor ® was cooled to room temperature while the milling was continued, and 45 lbs. of Isopar ®-H, nonpolar liquid having a Kauri-butanol value of 27 (Exxon), were added. Milling was continued for 23.25 hours to obtain toner particles with an average by area size of 1.8 μm.

The prepared developer was treated as follows:

The solid material was separated from the nonpolar liquid by centrifugation at 5000 rpm using a Du pont Instrument Sorvall SS-3 Automatic Centrifuge To a suspension, 64 grams, of this solid material in dichloromethane, were added 16 grams of 1-hydroxy-benzotriazole hydrate, 32 grams of octadecylamine, and 24 grams of dicyclohexylcarbodiimide, each in 50 grams of dichloromethane. After stirring the suspension overnight, the solid was separated from the dichloromethane and was rinsed with and then suspended in Isopar ®-L. 1000 grams of the suspension were then diluted to 0.5% solids with additional Isopar ®-L. This developer containing no charge director was designated Sample 1a.

Developer Sample 1b was prepared by positively charging a developer prepared as described above with 13.5 grams of zirconium octoate (6% solution) in Isopar ®-L per 880 grams of the deVeloper dispersion.

The developer was evaluated by toning a photopolymer xeroprinting master, a photopolymerizable composition containing 57.0% (by Weight) poly(styrenemeIhylethacrylate), 28.6% ethoxylated trimethylolpropane triacrylate, 10.6% 2,2',4,4'-tetrakis(o-chlorophenyl) - 5,5' - bis(m,p - dimethoxyphenyl) - biimidazole, and 3.8% 2-mercaptobenzoxazole coated on an 0.004 inch (0.0102 cm) aluminized polyethylene terephthalate film substrate and a 0.00075 inch (0.0019 cm) polypropylene cover sheet laminated to the dried photopolymerizable layer. The photopolymerizable element was exposed imagewise through a halftone negative film with its emulsion side in contact with the cover sheet, using a Douthitt Option X exposure unit (Douthitt Corp., Detroit, Mich.), equipped with a model TU 64 Violux 5002 lamp assembly (Exposure Systems Corp. Bridgeport, Conn.) and a photopolymer type 5027 lamp. For evaluation of positively charged developers, after removal of the cover sheet, the film was charged negatively by passing over a $^{-4.8}$ kV scorotron at 0.5 inch (12 7 mm)/second. The latent electrostatic image was toned at 0.5 inch (12.7 mm)/second using a 0.04 inch (1.02 mm) toner-filled gap between a flat development electrode and the charged film. Developer Sample 1a afforded no toning of the negatively-charged photopolymerized element other than the edge toning caused by dielectrophoresis. Using developer Sample 1b toned images with a range of 9–90% half-tone dots (150 line/inch screen) and good solid area coverage were achieved.

EXAMPLE 2

The solid material was made and surface-treated as described in Example 1 except that in the treatment procedure, 32 grams of poly(propylene glycol) were used in place of octadecylamine. The solid material suspended in Isopar ®-L was diluted to 0.5% solids with additional Isopar ®-L. Developer Sample 2a was prepared by positively charging developer prepared as described above by adding 13.5 grams of iron naphthenate to 877 grams of the developer. Sample 2b was prepared by positively charging developer prepared as described above with 1.3 grams of zirconium octoate per 897 grams of developer. Toned images were made as described in Example 1. With the developer Sample 2a a range of 9 to 90% toned halftone dots (150 line-/inch screen) was achieved, while with the developer Sample 2b images with a dot range of 9 to 95% were produced.

CONTROL 1

The toner was prepared as described in Example 1 but the solid material was left untreated. The solid material suspended in Isopar ®-L was I diluted to 0.5% solids toner with Isopar ®-L and charged with 2.5 grams of zirconium octoate to 1000 grams of developer in Control Sample a and 2.5 grams of iron naphthenate to 1000 grams of developer in Control Sample b. Toning was done as described in Example 1. No toned images were formed.

EXAMPLE 3

In an 01 Attritor ®, Union process Company. Akron, Ohio were placed the following ingredients:

| Ingredient | Amount (g) |
|---|---|
| Copolymer of ethylene (89%) and methacrylic acid (11%) melt index at 190° C. is 100, Acid No. is 66 | 35.0 |
| Isopar ®-L, nonpolar liquid having a Kauri-butanol value of 27, Exxon Corporation | 125.0 |

The ingredients were heated in the range of 90° C. to 110° C. and milled with 0.1875 inch (4.76 mm) diameter carbon steel balls for two hours. The Attritor ® was cooled to room temperature while the milling was continued, and an additional 125 g of Isopar ®-L were added. Milling was continued for 19 hours to obtain toner particles with an average by area size of 2.45 μm.

The developer was filtered through Whatman #1 filter paper and the solids collected and suspended in about 1 liter of dichloromethane. To this suspension was added 9 grams 1-hydroxybenzotriazole 18 grams of octadecylamine, and 14 grams of dicyclohexylcarbodiimide, each in 50 grams of dichloromethane. After stirring the suspension overnight. the solid was removed from the dichloromethane, rinsed with and suspended in Isopar ®-L. The suspension was then diluted to 0.5% solids with additional Isopar ®-L. The developer was charged positively by adding 1.9 grams of zirconium octoate to 777 grams of developer thus forming Sample 3a. Toning was carried out as described in Example 1. Toned images had a dot range of 9 to 90% (150 lines-/inch screen).

EXAMpLE 4

In an 01 Attritor ®, Union process Company, Akron. Ohio were placed the following ingredients:

| Ingredient | Amount (g) |
|---|---|
| Copolymer of ethylene (73%) and methacrylic acid (10%) and butyl acrylate (17%) | 30.0 |
| Heucophthal Blue G XBT-583D Heubach, Inc., Newark, NJ | 0.2 |
| Carbon black Sterling NS, Cabot Corp., Boston, MA | 3.6 |
| Isopar ®-L, nonpolar liquid having a Kauri-butanol value of 27, Exxon Corporation | 125.0 |

The ingredients were heated in the range of 90° C. to 110° C. and milled with 0.1875 inch (4.76 mm) diameter carbon steel balls for two hours. The o Attritor ® was cooled to room temperature while the milling was continued, and 125 g of Isopar ®-L were added Milling was continued for 21 hours to obtain toner particles with an average by area size of 1.45

For Sample 4a, a portion of this developer was diluted to 0.5% solids with Isopar ®-L. The developer (500 g) was charged with 1.25 g of zirconium octoate No toning of negatively charged photopolymerized element (described in Example 1) occurred. With a positively charged photopolymerized element, toned images with $2^{-93}$% halftone dots (150 lines/inch) were produced, indicating that the toner was negatively charged.

A second portion of the developer was surface-treated as described in Example 3, using 4.5 g of hydroxybenzotriazole, 9 g of octadecylamine, and 14 g of dicyclohexylcarbodiimide, with 16 g of toner solids. The resulting suspension was then diluted to 0.5% solids with Isopar ®-L. For Sample 4b, the developer was evaluated without charge director. With negatively charged photopolymerized element only toning by dielectrophoresis (edge toning) was observed. For Sample 4c the surface-treated toner Was charged by the addition of 1.25 g of zirooonium octoate to 500 g of developer. Toning of the nega-tively charged photopolymerized element provided a toned image with $4^{-85}$% halftone dots.

CONTROL 2

The resin was prepared using the following chemical modification procedure:

| Ingredient | Amount (g) |
|---|---|
| Copolymer of ethylene (89%) and methacrylic acid (11%) melt index at 190° C. is 100, Acid No. is 66 | 40.0 |
| Toluene (Aldrich Chemical Co.) | 300.0 |

In a 500 mL round bottom flask equipped with a condenser, stir bar, thermocouple and heating mantle were placed the resin and toluene. The mixture was heated to 90° C. +/−5° C. overnight. This resin was processed into developer as described in Example 4 using 30 g resin and 2.05 g Heucophthal Blue pigment giving toner particles with an average particle size by area of 1.645 μm. Additional Isopar ®-H was added to give a 2% solids developer to which 25 g of a 10% Basic Barium petronated solution in Isopar ®-H were added. Toning was carried out as described in Example 1. Very poor images were obtained for both positive and negative charging potentials.

EXAMPLE 5

The resin was modified as in Control 2 with the following exceptions: the resin solution was cooled to 80° C. and 4 mL oxalyl chloride, manufactured by Aldrich Chemical Co , Milwaukee, Wis., were added. After 1 hour at 80° C. the mixture was quenched as described in Control 2. Existence of the acid chloride was confirmed by the large infrared peak at 1810 $cm^{-1}$, which was absent in Control 2.

The resin prepared above was processed into developer as described in Control 2 to give a particle size of 1.62 μm and charged with 30 g of 10% Basic Barium petronated solution. Toning was carried out as described in Example 1. No image was obtained at positive potential but good images and solid area coverage were obtained with negative potential.

EXAMPLE 6

The resin was modified as described in Example 5 with the following exception: 2 mL of ethylene glycol, manufactured by Aldrich Chemical Co., Milwaukee, Wis. were added following the addition of oxalyl chloride to prepare the hydroxyethyl ester. After heating for 2 hours at 80° C., the mixture was quenched as described in Control 2.

The resin prepared aboVe was processed as in Control 2 to give a particle size of 2.05 μm and charged with 20 g of 10% Basic Barium petronated solution. Toning was carried out as described in Example 1. No image was obtained at positive potential but good images and solid area coverage were obtained with negative potential.

EXAMPLE 7

The resin was modified as described in Control 2 with the following exceptions: The mixture of 50 grams of ethylene copolymer resin and 500 mL of toluene was heated for about 2 hours until about 50 mL of distillate was collected in a Dean Stark trap. After cooling to 55° C. 9.0 grams of oxalyl chloride (Aldrich Chemical Co.) was added slowly with stirring. After 1 hour, 19.1 grams of 16 hydroxyhexadecanoic acid (Aldrich Chemical Co.) was added. The temperature was raised to 75° C. and stirred for 21 hours Temperature was raised to 90° C. to dissolve the new polymer and the liquid mixture was poured into 1000 mL of chloroform. The polymer was filtered and dried. A sample of the polymer was analyzed using infrared spectroscopy. The peak for the ester was present at 1740 $cm^{-1}$ and no evidence of the acid chloride peak at 1800 $cm^{-1}$ was observed.

A cyan developer was prepared using 35 grams of the above resin using the procedure described in Example 3 with the following exceptions: 2.43 grams of the Heucophthal Blue G XBT 583D pigment (Heubach, Inc., Newark, N.J.), and 0.02 gram of Dalamar ® Yellow TY−858D (Heubach, Inc., Newark, N.J.) were also added before milling. Cold milling was continued for 27 hours resulting in an average particle size by area of 1.15 μm. The particulate media were removed and the dispersion of toner particles was then diluted to 2 percent solids by weight with additional Isopar ®-L and a charge director, Basic Barium petronated was added at an amount of 189 mg of Basic Barium petronated ®/g of developer solids to give a bulk conductivity of 47 pmho/cm. Image quality was determined using a Savin 870 copier at standard mode: Charging corona set at positive 6.8 kv and transfer corona set at positive 8.0 kv using carrier sheets of plainwell off-set enamel paper number 3 class 60 lb. text.

A reverse image was obtained using positive charging potentials indicating positively charged toner particles.

We claim:

1. A positive-workinq liquid electrostatic developer consisting essentially of (A) nonpolar liquid having a Kauri-butanol value of less than 30, present in major amount, (B) thermoplastic resin selected from the group consisting of an ethylene homopolymer having a carboxylic acid substituent and copolymer of ethylene and at least one other monomer having a carboxylic acid substituent, the acid substituent being modified into a substituent selected from the group consisting of an ester. ester having substituents selected from the group consisting of hydroxyl, carboxyl, amine and alkyl of at least one carbon atom; amide, amide having substituent selected from the group consisting of hydroxyl, carboxyl, amine and alkyl of at least one carbon atom; and acid halide, the resin being in particulate form having an average particle size by (C) nonpolar liquid soluble ionic or zwitterionic compound.

2. A positive-working liquid electrostatic developer according to claim 1 wherein the thermo-plastic resin is an ethylene homopolymer having the carboxylic acid substituent modified into an ester substituent.

3. A positive-working liquid electrostatic developer according to claim 1 wherein the thermoplastic resin is an ethylene homopolymer having the carboxylic acid substituent modified into an amide substituent.

4. A positive-working liquid electrostatic developer according to claim 1 wherein the thermoplastic resin is an ethylene homopolymer having the carboxylic acid substituent modified into an acid halide substituent.

5. A positive-working liquid electrostatic developer according to claim 1 wherein the thermoplastic resin is a copolymer of ethylene (80 to 99.99%)/aocylio or methacry lic acid (20 to 0.01%)/alkyl ester of acrylic or methacrylic acid wherein alkyl is 1 to 5 carbon atoms (0 to 19.99%). the acid substituent being modified into an ester substituent.

6. A positive-working liquid electrostatic developer according to claim 1 wherein the thermoplastic resin is a copolymer of ethylene (80 to 99.99%)/acrylic or methacrylic acid (20 to 0.01%)/alkyl ester of acrylic or methacrylic acid wherein alkyl is 1 to 5 carbon atoms (0 to 19.99%). the acid substituent being modified into an amide substituent.

7. A positive-working liquid electrostatic developer according to claim 1 wherein the thermoplastic resin is a copolymer of ethylene (80 to 99.99%)/acrylic or methacrylic acid (20 to 0.01%)/alkyl ester of acrylic or methacrylic acid wherein alkyl is 1 to 5 carbon atoms (0 to 19,99%), the acid substituent being modified into an acid halide substituent.

8. A positive-working liquid electrostatic developer according to claim 5 wherein the thermoplastic resin that is modified is a copolymer of ethylene (80 to 99.99%)/acrylic or methacrylic acld (20 to 0.01%)

9. A positive-working liquid electrostatic develcper according to claim 6 wherein the thermoplastic resin that is modified is a copolymer of ethylene (80 to 99.99%)/acrylic or methacrylic acid (20 to 0.01%).

10. A positive-working liquid electrostatic developer according to claim 7 wherein the thermoplastic resin that is modified is a copolymer of ethylene (80 to 99.99%)/acrylic or methacrylic acid (20 to 0.01%).

11. A positive-working liquid electrostatic developer according to claim 8 wherein the thermoplastic resin that is modified is a copolymer of ethylene (89%)/methacrylic acid (11%) having a melt index at 190° C. of 100.

12. A positive-working liquid electrostatic developer according to claim 9 wherein the thermoplastic resin that is modified is a copolymer of ethylene (89%)/methacrylic acid (11%) having a melt index at 190° C. of 100.

13. A posltive-working liquid electrostatic developer according to claim 10 wherein the thermoplastic resin that is modified is a copolymer of ethylene (89%)/methacrylic acid (11%) having a melt index at 190° C. of 100.

14. A positive-working liquid electrostatic developer according to claim 11 wherein the modified copolymer is the ethyl ester substituent.

15. A positive-working liquid electrostatic developer according to claim 11 wherein the modified copolymer is the polypropylene ester substituent.

16. A positive-working liquid electrostatic developer according to claim 11 wherein the modified copolymer is the hexadecanoic acid ester substituent.

17. A positive-working liquid electrostatic developer according to claim 12 wherein the modified copolymer is the octadecyl amide substituent.

18. A positive-working liquid electrostatic developer according to claim 13 wherein the modified copolymer is the acid chloride substituent.

19. A positive-working liquid electrostatic developer according to claim 1 wherein component (A) is present in 85 to 99.99% by weight. based on the total weight of liquid developer, the total weight of developer solids is 0.01 to 15.0% by weight, and component (C) is present in an amount of 0.25 to 1500 mg/g developer solids.

20. A positive-working liquid electrostatic developer according to claim 1 containing up to about 60 percent by weight of a colorant based on the total weight of develope solids.

21. A positive-working liquid electrostatic developer according to claim 20 wherein the colorant is a pigment.

22. A positive-working liquid electrostatic developer according to claim 20 wherein the colorant is a dye.

23. A positive-working liquid electrostatic developer according to claim 1 wherein a fine particle size oxide is present.

24. A positive-workinq liquid electrostatic developer accordinq to claim 1 wherein an additional compound is present which is an adjuvant taken from the group consisting of polyhydroxy compound, aminoalcohol, polybutylene succinimide metallic soap, and an aromatic hydrocarbon.

25. A positive-working liquid electrostatic developer according to claim 20 wherein an additional compound is present which is an adjuvant taken from the group consisting of polyhydroxy compound, aminoalcohol, polybutylene succinimide, metallic soap, and an aromatic hydrocarbon.

26. A positive-working liquid electrostatic developer according to claim 24 wherein a polyhydroxy adjuvant compound is present.

27. A positive-working liquid electrostatic developer according to claim 24 wherein an aminoalcohol adjuvant compound is present.

28. A positive-working liquid electrostatic developer according to claim 24 wherein a polybutylene succinimide adjuvant compound is present.

29. A positive-Working liquid electrostatic developer according to Claim 24 wherein a metallic soap adjuvant compound is present dispersed in the thermoplastic resin particles.

30. A positive-working liquid electrostatic developer according to claim 24 wherein an aromatic hydrocarbon adjuvant compound is present.

31. A positive-working liquid electrostatic developer according to claim 27 wherein the aminoalcohol adjuvant compound is triisopropanolamine.

32. A positive-working liquid electrostatic developer according to claim 1 wherein the particles have an average by area particle size of less than 5 μm.

33. A positive-working liquid electrostatic toner according to claim 1 wherein component (C) is Basic Barium Petronate.

34. A positive-working liquid electrostatic toner according to claim 1 wherein component (C) is zirconium octoate.

35. A process for preparing a positive-working liquid electrostatic developer for electrostatic imaging comprising (A) mixing in a vessel at an elevated temperature a thermoplastic resin taken from the group consisting of an ethylene homopolymer having a carboxylic acid substituent and copolymer of ethylene and at least one other monomer, the copolymer having a carboxylic acid substituent, and a dispersant nonpolar liquid having a Kauri-butanol value of less than 30, while maintaining the temperature in the vessel at a temperature sufficient to plasticize and liquify the resin and below that at which the dispersant nonpolar liquid degrades and the resin decomposes, (B) cooling the dispersion with stirring to form thermoplastic resin particles having an average by area particle size of less than 10 μm, (C) separating the thermoplastic resin particles from the nonpolar liquid, (D) suspending the thermoplastic resin particles in an organic liquid, (E) reacting the suspension of the thermoplastic resin particles, in the presence of a dehydrating agent, with a compound selected from the group consisting of an alkylamine, alkylhydroxide, aminoalcohol, aminoacid, and hydroxyacid compound having at least one functional group and wherein alkyl contains at least one carbon atom to form modified resin particles having an amide and/or an ester substituent, (F) separating the modified resin particles from the suspension organic liquid and suspending the modified resin particles in nonpolar liquid, (G) charging positively the suspension by means of a nonpolar liquid soluble ionic or zwitterionic compound.

36. A process according to claim 35 wherein the thermoplastic resin that is modified is a copolymer of ethylene (80 to 99.99%) acrylic or methacrylic acid (20 to 0.01%)/alkyl ester of acrylic or methacrylic acid wherein alkyl is 1 to 5 carbon atoms (0 to 19.99%).

37. A process according to claim 36 wherein the alkylamine reactant is octadecylamine.

38. A process according to claim 36 wherein the hydroxy group containing compound reactant is poly(-propylene glycol).

39. A process according to claim 36 wherein the thermoplastic resin that is modified is a copolymer of ethylene (89%)/methacrylic acid (11%) having a melt index at 190° C. of 100.

40. A process according to claim 39 wherein the alkylamine reactant is octadecylamine.

41. A process according to claim 39 wherein the alkylhydroxide reactant is poly(propylene glycol).

42. A process according to claim 40 wherein the ionic or zwitterionic compound is Basic Barium petronate.

43. A process according to claim 40 wherein the ionic or zwitterionic compound is zirconium octoate.

44. A process according to claim 41 wherein the ionic or zwitterionic compound is Basic Barium Petronate.

45. A process according to claim 41 wherein the ionic or zwitterionic compound is zirconium octoate.

46. A process according to claim 35 wherein prior to charging positively the suspension of resin particles in nonpolar liquid is diluted with additional nonpolar liquid.

47. A process according to claim 35 where up to about 60% by weight of a colorant based on the weight of developer solids is present in step (A).

48. A process for preparing a positive-working liquid electrostatic developer for electrostatic imaging comprising (A) dissolving in an organic solvent in a vessel at an elevated temperature a thermoplastic resin taken from the group consisting of an ethylene homopolymer having a carboxylic acid substituent and copolymer of ethylene and at least one other monomer, the copolymer having a carboxylic acid substituent, the temperature in the vessel being below that at which the resin decomposes, (B) cooling the resin solution to a temperature sufficient for the resin to remain substantially dissolved and adding to the solution a halide-containing compound capable of reacting with the carboxylic acid substituent of the resin to form an acid halide, (C) quenching the acid halide at ambient temperature with a compound selected from the group consisting of alkylamine, alkylhydroxide, aminoalcohol, aminoacid, and hydroxy acid compound having at least one functional group and wherein alkyl contains at least one carbon atom, and drying (D) mixing in a vessel at an elevated temperature the modified resin and a dispersant nonpolar liquid having a Kauri-butanol value of less than 30, present in major amount. while maintaining the temperature in the vessel at a temperature sufficient to plasticize and liquify the resin and below that at which the dispersant nonpolar liquid degrades and the resin decomposes, thermoplastic resin particles having an average by area particle size of less than 10 μm, (F) charging positively the liquid developer by means of a nonpolar liquid soluble ionic or zwitterionic compound.

49. A process according to claim 48 wherein after step (A), steps (B) and (C) are replaced, respectively, by (B) reacting the resin, in the presence of a dehydrating agent, with a compound selected from the group consisting of an alkylamine, alkylhydroxide, aminoalcohol aminoacid and hydroxyacid compound having at least one functional group and wherein alkyl contains at least one carbon atom to form modified resin particles having an amide and/or an ester substituent, and cooling, if necessary, and (C) separating the modified resin from the organic solvent.

50. A process according to claim 48 wherein the thermoplastic resin that is modified is a copolymer of ethylene (80 to 99.99%)/acrylic or methacrylic acid (20 to 0.01%)/alkyl ester of acrylic or methacrylic acid wherein alkyl is 1 to 5 carbon atoms (0 to 19.99%).

51. A process according to claim 50 wherein the thermoplastic resin that is modified is a copolymer of ethylene (89%)/methacrylic acid (11%) having a melt index at 190° C. of 100.

52. A process according to claim 50 wherein the halide-containing compound is oxalyl chloride.

53. A process according to claim 51 wherein the halide-containing compound is oxaly chloride.

54. A process according to claim 48 wherein up to about 60 percent by weight of a colorant based on the Weight of developer solids is present in step (A).

55. A process according to claim 54 wherein the colorant is a pigment.

56. A process according to claim 35 wherein an additional compound is present which is an adjuvant taken from the group consisting of polyhydroxy compound, aminoalcohol, polybutylene succinimide, metallic soap, and an aromatic hydrocarbon.

57. A process according to claim 48 wherein an additional compound is present which is a adjuvant taken from the group consisting of polyhydroxy compound aminoalcohol, polybutylene succinimide, metallic soap, and an aromatic hydrocarbon.

58. A process according to claim 48 wherein the nonpolar liquid soluble ionic or zwitterionic compound is Basic Barium Petronate.

59. A process according to claim 48 wherein the nonpolar liquid soluble ionic or zwitterionic compound is zirconium octoate.

60. A process according to claim 48 wherein after step (A), steps (B) and (C) are replaced, respectively, by (B) reacting the resin with a halogenating agent to form modified resin particles having an acid halide substituent, and cooling if necessary, and (C) separating the modified resin from the organic solvent.

* * * * *

UNITED STATES PATENT AND TRADEMARK OFFICE

CERTIFICATE OF CORRECTION

PATENT NO. : 4,798,778

DATED : Jan. 17, 1989

INVENTOR(S) : El-Sayed et al.

It is certified that error appears in the above-identified patent and that said Letters Patent is hereby corrected as shown below:

On the title page, Inventor: El-Sayed Lyla M. et al. should be: El-Sayed et al.

Cover Page, [75] Inventors: El-Sayed Lyla M. Should be: Lyla M. El-Sayed

| Column | Line(s) | |
|---|---|---|
| 14 | 29 | ester. ester<br>Should be: ester, ester |
| 14 | 36 | Omission of line<br>...area of less than 10μm, and |
| 14 | 39 | thermo-plastic should not be hyphenated |
| 14 | 52 | /aocylio should be /acrylic |
| 14 | 53 | methacry lic should be methacrylic |
| 14 | 55 | to 19.99%). the... should be to 19.99%), the... |
| 14 | 62 | to 19.99%). the... should be to 19.99%), the... |
| 15 | 6 | needs period at end of claim |
| 15 | 48 | ...by weight. based...<br>period should be a comma |
| 15 | 55 | develope should be developer |

UNITED STATES PATENT AND TRADEMARK OFFICE

CERTIFICATE OF CORRECTION

PATENT NO. : 4,798,778

DATED : Jan. 17, 1989

INVENTOR(S) : El-Sayed et al.

It is certified that error appears in the above-identified patent and that said Letters Patent is hereby corrected as shown below:

| Column | Line(s) | |
|---|---|---|
| 15 | 67 | ...succinimide metallic soap... should be ...succinimide, metallic soap... |
| 16 | 16 | ...positive-Working...should be ...positive-working |

Signed and Sealed this

First Day of June, 1993

*Attest:*

*Attesting Officer*

Michael K. Kirk

MICHAEL K. KIRK

*Acting Commissioner of Patents and Trademarks*